US008888475B2

(12) United States Patent
Yanagase et al.

(10) Patent No.: US 8,888,475 B2
(45) Date of Patent: Nov. 18, 2014

(54) SCROLL COMPRESSOR WITH OIL SUPPLY ACROSS A SEALING PART

(75) Inventors: Yuichi Yanagase, Namegata (JP); Eiji Sato, Kasumigaura (JP); Isamu Tsubono, Ushiku (JP); Mutsunori Matsunaga, Shizuoka (JP); Satoshi Nakamura, Shizuoka (JP); Masatsugu Chikano, Mito (JP)

(73) Assignee: Hitachi Appliances, Inc., Tokyo (JP)

( * ) Notice: Subject to any disclaimer, the term of this patent is extended or adjusted under 35 U.S.C. 154(b) by 651 days.

(21) Appl. No.: 12/853,457

(22) Filed: Aug. 10, 2010

(65) Prior Publication Data

US 2011/0064596 A1 Mar. 17, 2011

(30) Foreign Application Priority Data

Sep. 11, 2009 (JP) ..... 2009-209930

(51) Int. Cl.

| | |
|---|---|
| ***F04C 18/02*** | (2006.01) |
| ***F01C 1/02*** | (2006.01) |
| ***F01C 21/04*** | (2006.01) |
| ***F04C 27/00*** | (2006.01) |
| ***F04C 29/02*** | (2006.01) |
| *F04C 23/00* | (2006.01) |

(52) U.S. Cl.

CPC ..... *F04C 18/0215* (2013.01); *F04C 18/0253* (2013.01); *F04C 27/005* (2013.01); *F04C 29/028* (2013.01); *F04C 23/008* (2013.01)

USPC ..... 418/55.6; 418/55.2; 418/55.4; 418/55.5

(58) Field of Classification Search

CPC .. F04C 18/0215; F04C 29/028; F04C 23/008; F04C 27/005; F04C 18/0253

USPC ..... 418/55.1–55.6

IPC ..... F01C 1/02,21/04

See application file for complete search history.

(56) References Cited

U.S. PATENT DOCUMENTS

| | | | | |
|---|---|---|---|---|
| 5,249,941 | A * | 10/1993 | Shibamoto | 418/55.6 |
| 5,520,526 | A * | 5/1996 | Fujio | 418/55.4 |
| 6,074,186 | A | 6/2000 | Lifson et al. | |
| 8,215,933 | B2 * | 7/2012 | Kim et al. | 418/55.6 |
| 2002/0110471 | A1 * | 8/2002 | Sun et al. | 418/55.6 |
| 2002/0119063 | A1 * | 8/2002 | Morozumi | 418/55.5 |

FOREIGN PATENT DOCUMENTS

| | | |
|---|---|---|
| CN | 1215806 A | 5/1999 |
| JP | 2002-161873 | 6/2002 |

(Continued)

OTHER PUBLICATIONS

Chinese Office Action Application No. 201010260522.7 dated Sep. 6, 2012 with English translation.

*Primary Examiner* — Mary A Davis

(74) *Attorney, Agent, or Firm* — Antonelli, Terry, Stout & Kraus, LLP.

(57) ABSTRACT

A scroll compressor is provided in which the amount of lubricant oil supply is appropriately controlled over a low to high rotational frequency range of the scroll compressor. The scroll compressor has an oil supply unit and an oil supply passage. The oil supply unit includes a small hole with a diameter not exceeding a seal ring width of the sealing part and a groove which are formed on the end plate of the boss portion on the back side of the orbiting scroll. As the orbiting scroll orbitally moves, oil in the high pressure hydraulic chamber pools in the small hole to be discharged, across the seal ring, into the back pressure chamber. The oil supply passage communicates between the high pressure hydraulic chamber and the back pressure chamber.

20 Claims, 13 Drawing Sheets

(56) References Cited

FOREIGN PATENT DOCUMENTS

| | | | | | |
|---|---|---|---|---|---|
| JP | 2003-176794 | | 6/2003 | | |
| JP | 2003176794 A | * | 6/2003 | ..... | F04C 18/02 |
| JP | 2004-019499 | | 1/2004 | | |
| JP | 2004019499 A | * | 1/2004 | ..... | F04C 18/02 |
| JP | 2005-248772 | | 9/2005 | | |

* cited by examiner

SCROLL COMPRESSOR WITH OIL SUPPLY ACROSS A SEALING PART

BACKGROUND OF THE INVENTION

The present invention relates to a scroll compressor for a refrigeration cycle handling, for example, a hydrofluorocarbon (HFC) refrigerant, a natural refrigerant such as air or carbon dioxide, or a compressed gas. The present invention is particularly suitable for application to a scroll compressor having a high-pressure (approximately equal to a discharge pressure) back pressure chamber (high pressure hydraulic chamber) formed on the back side of an orbiting scroll and a back pressure chamber kept at an intermediate pressure lower than the discharge pressure or at an intake pressure with the two chambers at different pressures partitioned pressure-wise by a sealing part.

Scroll compressors are widely used for refrigerators and air-conditioners in various fields. Compared with other types of compressors such as reciprocating compressors and rotary compressors, scroll compressors are said to be superior in various characteristics, for example, operational efficiency, reliability, and quietness.

Scroll compressors are disclosed, for example, in JP-A No. 2003-176794 and JP-A No. 2004-19499.

In the scroll compressor disclosed in JP-A No. 2003-176794, a high-pressure back pressure chamber (high pressure hydraulic chamber) formed around a central portion on the back side of an orbiting scroll and a low-pressure (intake pressure or intermediate pressure) back pressure chamber formed in an outer peripheral portion are sealed by a sealing part provided on a frame end surface facing a boss-portion end surface on the back side of the orbiting scroll. In the scroll compressor, the boss-portion end surface has small holes for holding lubricating oil coming from the high pressure hydraulic chamber, and, by making the orbiting scroll engage in orbital motion to cause the small holes holding lubricating oil to move back and forth across the sealing part, lubricating oil is intermittently supplied from the high pressure hydraulic chamber to the low-pressure back pressure chamber formed in an outer peripheral portion. The lubricating oil thus supplied to the low-pressure back pressure chamber lubricates sliding parts such as an Oldham's ring, then enters a compression chamber from its intake side to lubricate the scroll wraps engaged with each other to be subsequently discharged, together with the compressed refrigerant, through a discharge port.

In the scroll compressor disclosed in JP-A No. 2003-176794, the amount of lubricating oil supplied from the high pressure hydraulic chamber to the back pressure chamber (low pressure chamber) can be adjusted by changing the size of the small holes. The leakage of lubricant oil into the low pressure chamber can therefore be easily adjusted to an appropriate amount, and the efficiency and reliability of the scroll compressor can be improved.

In the scroll compressor disclosed in JP-A No. 2004-19499, a lubricating oil reservoir (high pressure hydraulic chamber) provided in a central portion on the back side of the orbiting scroll and a low-pressure back pressure chamber provided in an outer peripheral portion are communicated with each other through an oil supply passage made up of a small hole (with a diameter of 0.2 to 0.5 mm) and a long hole. The orbiting scroll is made to orbitally move, thereby, causing the lubricating oil inlet of the small hole to move back and forth across an annular sealing member. This intermittently communicates the high pressure hydraulic chamber and the low-pressure back pressure chamber causing lubricating oil to be supplied from the lubricating oil reservoir to the back pressure chamber. According to JP-A No. 2004-19499, this arrangement makes it possible to appropriately control the amount of lubricating oil which tends to be supplied excessively due to a large differential pressure.

SUMMARY OF THE INVENTION

With energy saving strongly required in recent years, annual energy efficiency data has come to be indicated as an annual performance factor (APF) on air conditioners. The APF of an air conditioner is largely affected by the operational efficiency of the air conditioner in low-speed conditions referred to as intermediate conditions. To improve the efficiency of a compressor in low-speed conditions (i.e. operating in a low rotational frequency range), increasing the amount of lubricating oil supplied to its compression chamber and improving sealing of the compression chamber is effective.

In the scroll compressor disclosed in JP-A No. 2003-176794, when the scroll compressor is operating at a low rotational frequency, lubricating oil is intermittently supplied from the high pressure hydraulic chamber to the back pressure chamber through a small hole formed in the boss-portion end surface on the back side of the orbiting scroll (pocket oil-supply system), so that the amount of lubricating oil supplied to the low-pressure back pressure chamber increases with the rotational frequency of the scroll compressor. To secure a required amount of lubricating oil at a low rotational frequency, it is necessary to implement an appropriate measure such as increasing the number of small holes.

Increasing the number of small holes, however, can excessively increase the amount of lubricating oil supplied to the low-pressure back pressure chamber during operation at a high rotational frequency. This increases the power loss of lubricating oil caused when the lubricating oil is agitated by the orbiting scroll in the back pressure chamber and lowers the efficiency of the scroll compressor. In another problem also caused, a large amount of lubricating oil is mixed in the compressed gas discharged from the compression chamber resulting in increasing the amount of lubricating oil led into a refrigeration cycle from the discharge pipe (i.e. the amount of oil discharge) and decreasing the amount of lubricating oil held in the scroll compressor.

In the scroll compressor disclosed in JP-A No. 2004-19499, lubricating oil is intermittently supplied to the back pressure chamber using a differential pressure, so that the amount of lubricating oil supplied to the back pressure chamber does not increase even when the rotational frequency of the scroll compressor rises. This makes lubrication inadequate when the scroll compressor is operating at a high rotational frequency to possibly cause sliding portions of such parts as the Oldham's ring and scroll wraps to be seized. Enlarging the small hole in an attempt to increase the amount of lubricating oil supplied to the back pressure chamber can make lubrication during operation at a low rotational frequency excessive.

An object of the present invention is to provide a highly efficient and reliable scroll compressor in which an adequate amount of lubricating oil can be supplied from a high pressure hydraulic chamber to a low-pressure back pressure chamber even during operation at a low rotational frequency whereas the amount of lubricating oil does not excessively increase during operation at a high rotational frequency.

Another object of the present invention is to provide a scroll compressor in which an appropriate amount of lubricating oil can be supplied from a high pressure hydraulic chamber to a back pressure chamber over a low to high rotational frequency range, whereas the lubrication of a sealing member sealing the high pressure hydraulic chamber and the back pressure chamber is improved to reduce oil leakage through the sealing member and enhance the slidability of the sealing member.

To achieve the above objects, the present invention provides a scroll compressor which includes a fixed scroll and an orbiting scroll each having an end plate and a spiral wrap erected on the end plate, a compression chamber formed by the fixed scroll and the orbiting scroll engaged with each other, a crankshaft for orbitally moving the orbiting scroll, an orbiting bearing provided in a boss portion on a back side of the orbiting scroll to support the orbiting scroll axially movably and rotatably relative to an eccentric pin portion of the crankshaft, a frame on a fixed side facing the back side of the orbiting scroll, a main bearing attached to the frame to rotatably support the crankshaft, a sealing part for sealing between the back side of the orbiting scroll and the frame, and a high pressure hydraulic chamber formed in an inner peripheral portion and a back pressure chamber formed in an outer peripheral portion partitioned by the sealing part and in which the high pressure hydraulic chamber is kept approximately at a discharge pressure with lubricating oil approximately at the discharge pressure supplied thereto and the back pressure chamber is kept at a pressure lower than the discharge pressure. The scroll compressor comprises: an oil supply unit including a small hole formed in a portion, facing the sealing part, of the back side of the orbiting scroll or in the frame, the small hole being caused, by the orbital motion of the orbiting scroll, to move across the sealing part such that the small hole is alternately open to the high pressure hydraulic chamber and the back pressure chamber allowing oil in the high pressure chamber to be supplied to the back pressure chamber; and an oil supply passage formed in the orbiting scroll or the frame, the oil supply passage communicating between the high pressure hydraulic chamber and the back pressure chamber and causing oil in the high pressure hydraulic chamber to be supplied, by a differential pressure, to the back pressure chamber.

The present invention also provides a scroll compressor in which a fixed scroll and an orbiting scroll each having a spiral wrap erected on a disk-like end plate are, with the spiral wraps of both scrolls on an inner side, engaged with each other, the orbiting scroll is engaged with an eccentric pin portion connected to a crankshaft, the orbiting scroll is made to orbitally move about the fixed scroll without rotating, the fixed scroll has a discharge port open to a central portion and an intake port open to an outer peripheral portion, a gas is sucked in through the intake port, a compression space formed by the fixed scroll and the orbiting scroll is moved centerward to be reduced to compress the gas, and the compressed gas is discharged from the discharge port. The scroll compressor comprises: an oil supply unit including a high pressure hydraulic chamber and a back pressure chamber partitioned, on an end-plate back side of the orbiting scroll, by a sealing part, the end-plate back side of the orbiting scroll having a small hole with a diameter not exceeding a seal ring width of the sealing part, wherein, as the orbiting scroll having the small hole orbitally moves, oil in the high pressure hydraulic chamber formed in the orbiting boss portion of the orbiting scroll pools in the small hole to be discharged, across the seal ring, into the back pressure chamber; and an oil supply passage formed in the orbiting scroll or the frame, the oil supply passage communicating between the high pressure hydraulic chamber and the back pressure chamber and causing oil in the high pressure hydraulic chamber to be supplied, by a differential pressure, to the back pressure chamber.

It is appropriate that, in the scroll compressor: the oil supply passage for supplying, by a differential pressure, oil in the high pressure hydraulic chamber to the back pressure chamber is provided in a portion, facing the sealing part, of the orbiting scroll; and the high pressure hydraulic chamber in the orbiting boss portion and the back pressure chamber are caused, by the orbital motion of the orbiting scroll, to intermittently communicate with each other via the seal ring of the sealing part so as to cause oil in the high pressure hydraulic chamber in the orbiting boss portion to be intermittently discharged to the back pressure chamber. In the scroll compressor, the oil supply passage for supplying, by a differential pressure, oil in the high pressure hydraulic chamber to the back pressure chamber may be a groove formed on a back side portion, facing the sealing part, of the orbiting scroll. Furthermore, the scroll compressor may include a plurality of the grooves circularly spaced apart on a boss-portion end surface of the orbiting scroll so as to cause the high pressure hydraulic chamber and the back pressure chamber to be intermittently communicated with each other as the orbiting scroll orbitally moves. This allows intermittent lubrication by a differential pressure and makes it easier to control the amount of lubricating oil supply. Preferably, the plurality of the grooves is circularly spaced approximately 90 degrees apart.

In the scroll compressor, there may be at least provided a plurality of the grooves circularly spaced apart to be positionally approximately symmetric on a boss-portion end surface of the orbiting scroll so as to cause, even when the orbiting scroll orbitally moves, the high pressure hydraulic chamber and the back pressure chamber to be kept communicated with each other through at least one of the plurality of the grooves.

Preferably, in the scroll compressor, a first end of the groove is communicated with the small hole and a second end of the groove is kept open to one of the high pressure hydraulic chamber and the back pressure chamber. Also, preferably, the groove has a width smaller than the diameter of the small hole.

Furthermore, in the scroll compressor, the oil supply passage for supplying, by a differential pressure, oil in the high pressure hydraulic chamber to the back pressure chamber may be a long hole formed in the boss portion of the orbiting scroll to keep the high pressure hydraulic chamber and the back pressure chamber communicated with each other.

A scroll compressor according to the present invention includes an oil supply unit and an oil supply passage. In the oil supply unit, a small hole formed in a portion, facing a sealing part, of a back side of an orbiting scroll or formed in a frame is made to move, as the orbiting scroll orbitally moves, back and forth across the sealing part to be communicated alternately with a high pressure hydraulic chamber and a back pressure chamber, thereby, causing lubricating oil to be supplied from the high pressure hydraulic chamber to the back pressure chamber. The oil supply passage is formed in the orbiting scroll or in the frame to communicate between the high pressure hydraulic chamber and the back pressure chamber, thereby allowing lubricating oil to be supplied, using the differential pressure between the two chambers, from the high pressure hydraulic chamber to the back pressure chamber. In this arrangement, an adequate amount of lubricating oil can be supplied from the high pressure hydraulic chamber to the low-pressure back pressure chamber even during operation at a low rotational frequency, whereas the amount of lubricating oil does not excessively increase during operation at a high rotational frequency, so that the scroll compressor can be made highly efficient and reliable.

An appropriate amount of lubricating oil can be supplied from the high pressure hydraulic chamber to the back pressure chamber over a low to high rotational frequency range, whereas the lubrication of the sealing member sealing the high pressure hydraulic chamber and the back pressure chamber is improved. Therefore, oil leakage through the sealing member can be reduced and the slidability of the sealing member can be improved.

BRIEF DESCRIPTION OF THE SEVERAL VIEWS OF DRAWING

DETAILED DESCRIPTION OF THE INVENTION

Figure 1:
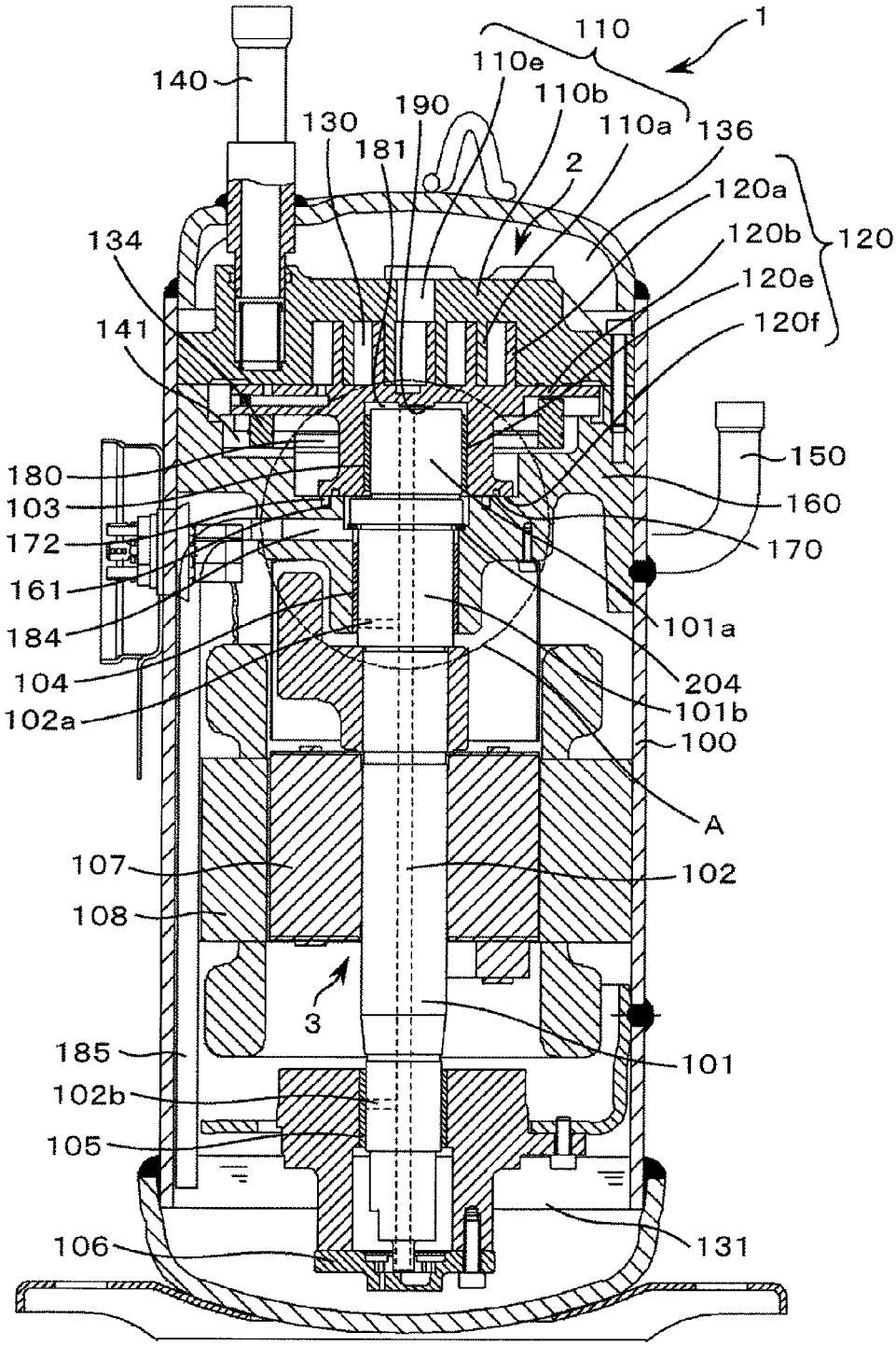
FIG. 1 is a longitudinal sectional view of a scroll compressor according to a first embodiment of the present invention.

A basic structure of a scroll compressor according to embodiments of the present invention will be described below.

A high pressure hydraulic chamber formed in a central portion on a back side of an orbiting scroll and a low-pressure back pressure chamber formed outside the high pressure hydraulic chamber are sealingly partitioned by a sealing part provided on a frame end-surface facing a boss-portion end surface on the back side of the orbiting scroll. The boss-portion end surface has small holes each formed approximately at a width center thereof. The boss-portion end surface of the orbiting scroll also has grooves formed thereon for communication between the small holes and the high pressure hydraulic chamber or an outer peripheral portion (back pressure chamber) of the boss portion. These small holes and grooves forming oil supply passages are caused to move back and forth across the sealing part between the high pressure hydraulic chamber and the back pressure chamber so as to intermittently supply lubricating oil in the high pressure hydraulic chamber to the low-pressure back pressure chamber.

In the above arrangement, when the scroll compressor is operating at a low rotational frequency, the amount of lubricating oil supplied through the small holes is small, but an adequate amount of lubricating oil can be supplied through the grooves. When the scroll compressor is operating at a high rotational frequency, on the other hand, the amount of lubricating oil supplied through the small holes increases to secure adequate lubrication required for high-speed operation. Thus, using both the grooves and the small holes makes it possible to appropriately control the amount of lubricating oil supplied from the high pressure hydraulic chamber to the low-pressure back pressure chamber over a low to high range of operating speed of the scroll compressor.

The grooves need not necessarily be communicated with the small holes. The grooves may each extend, without being communicated with any one of the small holes, from a radial position, where one of the small holes is positioned, on the boss-portion end surface to either an inner peripheral portion or an outer peripheral portion of the boss-portion end surface. In such an arrangement, too, it is possible, by making the small holes and grooves move back and forth across the sealing part, to intermittently supply lubricating oil from the high pressure hydraulic chamber to the low-pressure chamber through the small holes and grooves.

When the grooves are provided such that at least one of them extends from a radial position, where one of the small holes is positioned, on the boss-portion end surface to an inner peripheral portion of the boss-portion end surface with at least another one of them extending from a radial position, where one of the small holes is positioned, on the boss-portion end surface to an outer peripheral portion of the boss-portion end surface, lubricating oil can be supplied continuously from the high pressure hydraulic chamber to the low-pressure back pressure chamber. In such an arrangement, too, it is possible to obtain operational effects similar to those generated in the foregoing arrangements. Since, in such an arrangement, too, sealing member lubrication can be improved, the sliding performance of the sealing member is improved and leakage through the sealing member can be reduced.

Furthermore, without forming the grooves, a long hole may be formed in the boss portion so as to keep the high pressure hydraulic chamber in the boss portion of the orbiting scroll and the low-pressure back pressure chamber outside the boss portion communicated with each other, and lubrication may be effected using both the long hole and the small holes.

Embodiments of the present invention will be described in the following with reference to drawings.

First Embodiment

A first embodiment of the present invention will be described with reference to FIGS. 1 to 5.

FIG. 1 illustrates an overall structure of a scroll compressor of a first embodiment. A scroll compressor 1 includes a compression mechanism section 2 and a drive section 3 both housed in a hermetic container 100.

The compression mechanism section 2 includes a fixed scroll 110, an orbiting scroll 120, and a frame 160. The fixed scroll 110 has an end plate 110*b*, a spiral wrap (scroll wrap) 110*a* erected vertically to the end plate 110*b*, and a discharge port 110*e* formed through a center portion of the scroll wrap 110*a* and is fixed to the frame 160 by plural bolts. The orbiting scroll 120 has an end plate 120*b* and a spiral wrap (scroll wrap) 120*a* erected vertically to the end plate 120*b*. The end plate 120*b* has a boss portion 120*e* formed on its back side. The boss portion 120*e* has an end surface (boss end surface) 120*f*.

A compression chamber 130 is formed by the fixed scroll 110 and the orbiting scroll 120 engaged with each other. The compression chamber 130 effects compression by having its inner volume reduced by orbital motion of the orbiting scroll 120. In the compression operation, as the orbiting scroll orbitally moves, a working fluid such as a refrigerant is sucked into the compression chamber 130 through an intake port 140. After being compressed in the compression chamber 130, the working fluid is discharged into a discharge space 136 formed in the hermetic container 100 through the discharge port 110*e* of the fixed scroll 110 to be then discharged outside the hermetic container 100 through a discharge port 150. This keeps the space in the hermetic container 100 at the discharge pressure.

A drive section 3 for orbitally moving the orbiting scroll 120 includes a stator 108, a rotor 107, a crankshaft 101, an Oldham's coupling 134 which is a principal part of a mechanism for preventing the orbiting scroll 120 from rotating, a frame 160, a main bearing 104, a subsidiary bearing 105, and an orbiting bearing 103. The crankshaft 101 includes a main shaft portion 101*b* and an eccentric pin portion 101*a* formed integrally with the main shaft portion 101*b*. The main bearing 104 and the subsidiary bearing 105 rotatably support the main shaft portion 101*b* of the crankshaft 101. The orbiting bearing 103 is provided for the orbiting scroll 120 to hold the eccentric pin portion 101*a* of the crankshaft 101 axially movably and rotatably.

The main bearing 104 and the subsidiary bearing 105 supporting the main shaft portion 101*b* of the crankshaft 101 are provided on the compression mechanism 2 side and toward an oil pool 131, respectively, of the motor including the stator 108 and the rotor 107. The main bearing 104 is preferably a slide bearing, but it may also be a roller bearing. The subsidiary bearing 105 shown in FIG. 1 is a slide bearing, but it may be a roller bearing or spherical bearing applicable to operating conditions of the scroll compressor.

The Oldham's coupling 134 is for preventing the orbiting scroll 120 from rotating relative to the fixed scroll 110 and is provided in a back pressure chamber 180 formed by the orbiting scroll 120 and the frame 160. The Oldham's coupling 134 has two perpendicularly crossing key portions formed thereon. Of the two key portions, one slides in a keyway 141 formed on the frame 160 and the other slides in a keyway formed on the back side of the orbiting scroll 120.

Figure 2:
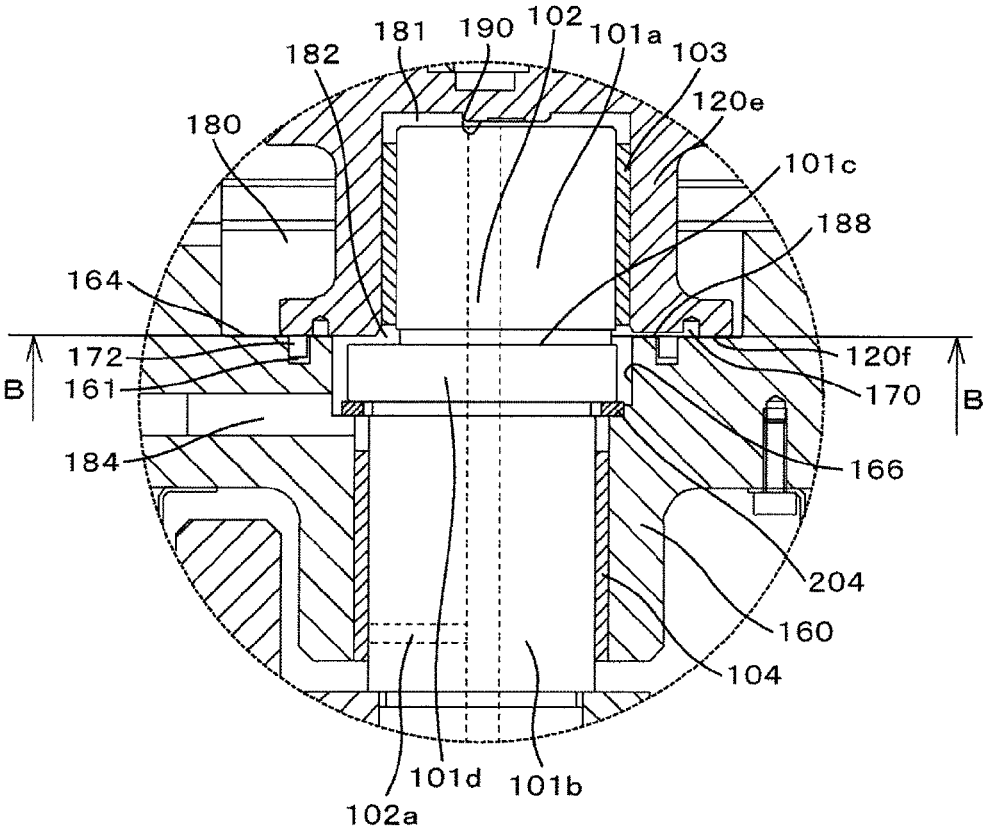
FIG. 2 is an enlarged view of portion A shown in FIG. 1.

With reference to FIGS. 1 and 2, a sealing part separating a high pressure hydraulic chamber (with a pressure almost equal to the discharge pressure) formed on the back side of the orbiting scroll 120 and the back pressure chamber (with a pressure lower than the discharge pressure) and a passage leading from the high pressure hydraulic chamber to the back pressure chamber will be described. FIG. 2 is an enlarged view of a portion around the high pressure hydraulic chamber and the back pressure chamber shown in FIG. 1 (portion A in FIG. 1).

The space formed on the back side of the orbiting scroll 120 is surrounded by the orbiting scroll 120, the frame 120 and the fixed scroll 110. The sealing part separating the high pressure hydraulic chamber and the back pressure chamber includes the boss end surface 120*f* on the back side of the orbiting scroll 120, a frame end surface 164 facing the boss end surface 120*f*, an annular groove 161 formed on the frame end surface 164, and a sealing member 172 fitted in the annular groove 161. The boss end surface 120*f* serves as a sealing surface to be in contact with the sealing member 172, so that it is required to have a smooth-finished surface. The sealing member 172 separates, pressure-wise, the back pressure chamber 180 and the high pressure hydraulic chamber 182. The high pressure hydraulic chamber 182 includes a central space 181 formed by the orbiting bearing 103 and the eccentric pin portion 101*a*, and a space formed by the boss end surface 120*f* and an outer peripheral portion of a flange portion 101*d* of the crankshaft 101. In the high pressure hydraulic chamber 182, the lubricating oil having lubricated the orbiting bearing 103, the main bearing 104, and a thrust bearing 204 is pooled by the sealing member 172. Even though the high pressure hydraulic chamber 182 is affected by pressurization by pumping operation of an oil pump 106 provided at the lower end of the crankshaft 101 and depressurization caused when passing a bearing portion or gap portion, it is kept approximately at the discharge pressure.

The thrust load generated when the eccentric pin portion 101*a* of the crankshaft 101 moves upward is received by a projecting thrust receiving surface 190 formed on the back side of the orbiting scroll 120. The thrust receiving surface 190 has a concave portion so as not to block an oil supply passage 102 formed on the crankshaft 101 when the end surface of the eccentric pin portion 101*a* of the crankshaft 101 comes into contact with the thrust receiving surface 190. Reference numeral 102*a* denotes an oil supply passage communicating between the main bearing 104 and the oil supply passage 102 that communicates between the oil pool 131 and the central space 181 formed in the boss portion of the orbiting scroll 120. Reference numeral 102*b* denotes an oil supply passage communicating between the subsidiary bearing 105 and the oil supply passage 102. Much of the lubricating oil supplied to the main bearing 104 and the orbiting bearing 103 is returned to the oil pool 131 at the bottom of the hermetic container 100 through a waste oil passage 184 and a waste oil pipe 185. The thrust receiving surface 190 and the upper end surface of the eccentric pin portion 101*a* are arranged such that, when the eccentric pin portion 101*a* of the crankshaft 101 comes into its uppermost position, the boss end surface 120*f* on the back side of the orbiting scroll 120 does not come into contact with an upper surface 101*c* of the flange portion 101*d* of the crankshaft 101. Sliding portions of parts such as the Oldham's coupling 134 provided in the back pressure chamber 180 are supplied with part of the lubricating oil supplied to the high pressure hydraulic chamber 182 through small holes 170 formed on the boss end surface 120*f* to intermittently communicate the high pressure hydraulic chamber 182 and the back pressure chamber 180. The small holes 170 are communicated with the high pressure hydraulic chamber 182 in the boss portion through two grooves 188 formed on the boss end surface 120*f* to be circularly 90 degrees apart.

Figure 3:
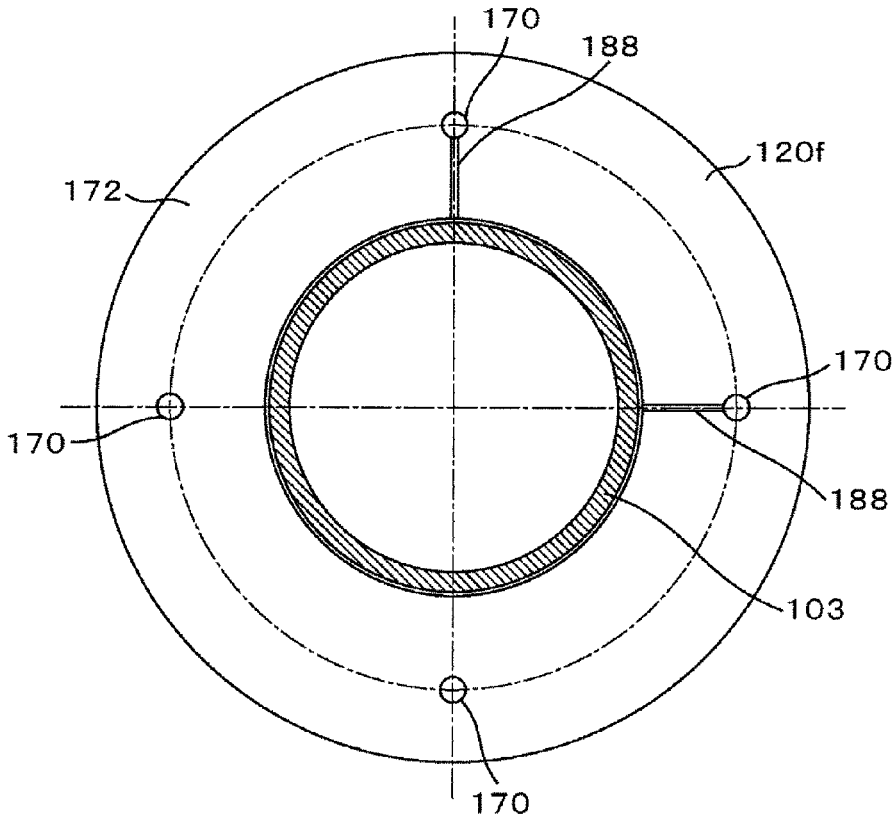
FIG. 3 is a sectional view taken along line B-B in FIG. 2.

FIG. 3 is a sectional view taken along line B-B in FIG. 2, showing a portion around the boss end surface 120*f* of the orbiting scroll 120. As shown in FIG. 3, the four small holes 170 are formed on the boss end surface 120*f* to be circularly spaced 90 degrees apart with each positioned approximately at the width center of the boss end surface 120*f*. Of the four small holes 170, two which are spaced 90 degrees apart are each communicated with one of the grooves 188 that are communicated with the high pressure hydraulic chamber 182 in the boss portion. The two grooves 188 are located not symmetrically about the center of the boss end surface 120*f* (to be 180 degrees apart) but 90 degrees apart allowing the high pressure hydraulic chamber 182 and the back pressure chamber 180 to be intermittently communicated with each other when the orbiting scroll 120 orbitally moves.

According to the present embodiment, part of the lubricating oil supplied to the high pressure hydraulic chamber 182 can be supplied to the back pressure chamber 180 through the small holes 170 formed on the boss end surface 120 and the grooves 188 each communicated with one of the small holes 170. This makes it possible to appropriately lubricate the scroll compressor operating in a low to high speed range.

Namely, when the scroll compressor is operating at a low rotational frequency, the back pressure chamber is lubricated mainly by differential pressure lubrication through the grooves 188. As long as the high pressure hydraulic chamber and the back pressure chamber are communicated with each other through the grooves 188, a required amount of lubrication can be secured by the differential pressure lubrication. In an existing type of scroll compressor using a pocket supply system in which only the small holes 170 are used without any groove added, the amount of lubricating oil supply is proportional to the rotational frequency of the scroll compressor, so that an adequate amount of lubricating oil cannot be secured during operation at a low rotational frequency. According to the present embodiment, during operation at a low rotational frequency, the lubricating oil supplied by a differential pressure through the grooves 188 relatively increases resulting in increasing the total lubrication at a low rotational frequency. This improves lubrication of sliding parts and sealing of the compression mechanism section 2, so that the efficiency of the scroll compressor is improved.

When the scroll compressor is operating at a high rotational frequency, the back pressure chamber is lubricated mainly, through the small holes 170, by a pocket supply system in which the amount of lubricating oil supplied increases with the rotational frequency of the scroll compressor. In this way, the back pressure chamber requiring more lubricating oil when the scroll compressor is operating at a higher rotational frequency can be supplied with an adequate amount of lubricating oil, so that the reliability of the scroll compressor is improved. In an existing differential pressure lubrication system, the amount of lubricating oil supplied is almost constant regardless of the rotational frequency of the scroll compressor. In such a lubrication system, adjustment to prevent lubrication from becoming excessive at a low rotational frequency of the scroll compressor makes lubrication inadequate when the scroll compressor is operating at a high rotational frequency.

Figure 4A:
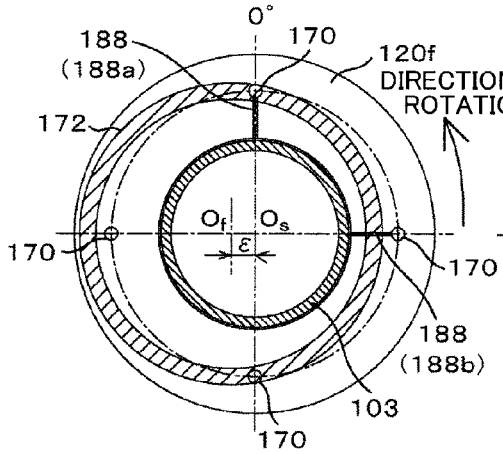
FIGS. 4A to 4D are diagrams for explaining the principle of operation of the first embodiment.
Figure 4B:
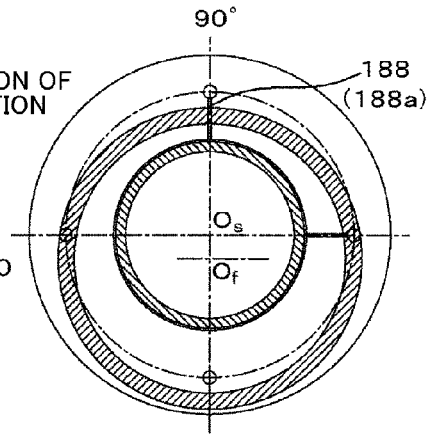

The principle of operation of the present embodiment will be described with reference to FIGS. 4A to 4D in which symbol Os denotes the center of the boss end surface 120*f* on the back side of the orbiting scroll 120, symbol Of denotes the circular center of the sealing member 172 provided on the frame 160, and symbol $\epsilon$ denotes the eccentric radius, i.e. the distance between Os and Of. During the time when the scroll compressor moves from a state of phase angle 0 degree (shown in FIG. 4A) to a state of phase angle 90 degrees (shown in FIG. 4B), the high pressure hydraulic chamber (high pressure side) inside the sealing member 172 and the back pressure chamber (low pressure side) outside the sealing member 172 are communicated with each other through at least one of the two grooves 188. After the scroll compressor reaches a state of phase angle 180 degrees (shown in FIG. 4C) and before reaching a state of phase angle 270 degrees (shown in FIG. 4D), neither of the two grooves 188 communicates between the high pressure hydraulic chamber inside the sealing member 172 and the back pressure chamber outside the sealing member 172. Namely, as illustrated in FIGS. 4A to 4D, with the two grooves 188 circularly spaced 90 degrees apart, the high pressure hydraulic chamber and the back pressure chamber can be communicated with each other during a one-fourth range (0 to 90 degrees) out of a full turn range (0 to 360 degrees), enabling intermittent lubrication through at least one of the grooves 188. (In reality, of the two grooves 188 (188*a* and 188*b* as shown in FIG. 4A), the groove 188*b* starts communicating between the high pressure hydraulic chamber and the back pressure chamber during the time the scroll compressor moves from the state shown in FIG. 4D to the state shown in FIG. 4A, and the groove 188*a* starts communicating between the two chambers during the time the scroll compressor moves from the state shown in FIG. 4B to the state shown in FIG. 4C. The two chambers are, therefore, communicated with each other in a phase angle range of about 315 degrees to 0 degree to 135 degrees, that is, differential pressure lubrication is effected during about one-half portion of a full turn range.) Furthermore, the differential pressure lubrication is added to by the lubricating oil intermittently supplied, by pocket oil-supply, from the high pressure hydraulic chamber to the back pressure chamber through the small holes 170 not communicated with the grooves 188. Therefore, when the scroll compressor is operating at a low rotational frequency, the amount of lubricating oil supplied by pocket oil-supply is small, but appropriate lubrication can be maintained by intermittent differential pressure lubrication effected through the grooves 188. Even though, in the present embodiment, the two grooves 188 are provided to be circularly spaced 90 degrees apart, there may be only one groove 188 or three or more grooves 188 spaced by an angle other than 90 degrees apart depending on specific requirements of intermittent lubrication.

Figure 5:
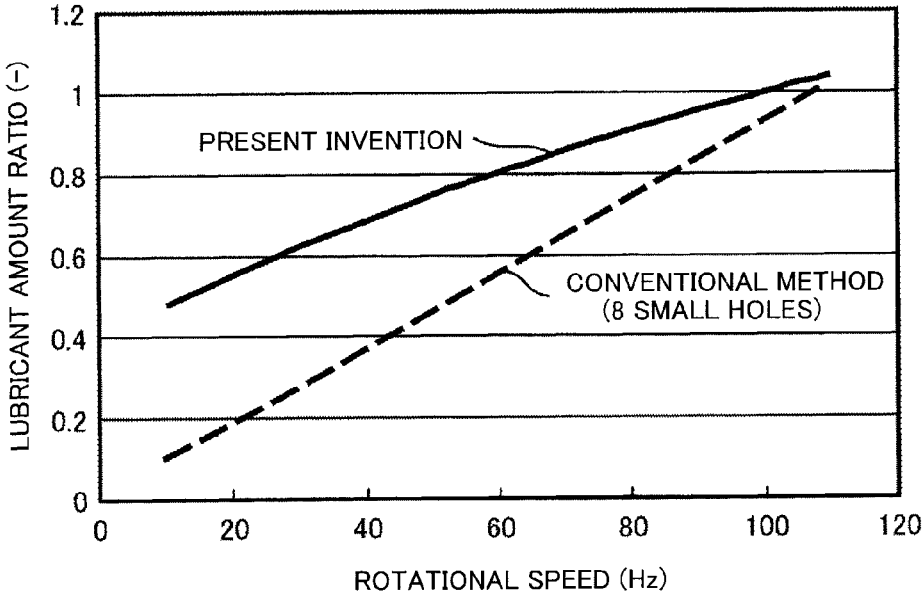
FIG. 5 is a diagram of oil amount ratio vs. rotational frequency, illustrating effects of the first embodiment.

FIG. 5 is a diagram illustrating effects of the present embodiment based on comparison with a conventional method (in which a pocket oil-supply system is used with eight small holes formed in a boss end surface). In FIG. 5, the horizontal axis represents rotational frequency and the vertical axis represents oil amount ratio, that is, the ratio of the amount of lubricating oil supplied at a rotational frequency relative to the amount supplied at a high-speed operation (at a rotational frequency of 100 Hz) set as a reference condition for securing a required amount of lubricating oil. In the conventional method of a pocket oil-supply system, the amount of lubricating oil supplied increases with the rotational frequency of the scroll compressor. When the rotational frequency is low, for example, 20 Hz, the amount of lubricating oil supplied is proportionally small and inadequate lubrication results. A design change if made to provide adequate lubrication even at a low rotational frequency makes lubrication excessive at a high rotational frequency. As a result, an agitation loss caused by agitating the oil by the orbiting scroll increases and a large amount of oil is led from the discharge pipe into a refrigeration cycle to lower the efficiency of the scroll compressor.

In the present embodiment, on the other hand, both a differential pressure lubrication system which can secure lubrication using grooves without being affected by the rotational frequency of the scroll compressor and a pocket oil-supply system using small holes are made use of. Therefore, when the scroll compressor is operating at a low rotational frequency, adequate lubrication is secured by differential pressure lubrication using grooves. When the scroll compressor is operating at a high rotational frequency, required lubrication is secured by the pocket oil-supply system using small holes in which the amount of lubricating oil supplied increases with the rotational frequency. Thus, the present embodiment realizes a scroll compressor which can operate highly reliably and efficiently over a low to high range of rotational frequency causing neither inadequate lubrication nor excessive lubrication.

Second Embodiment

Figure 6:
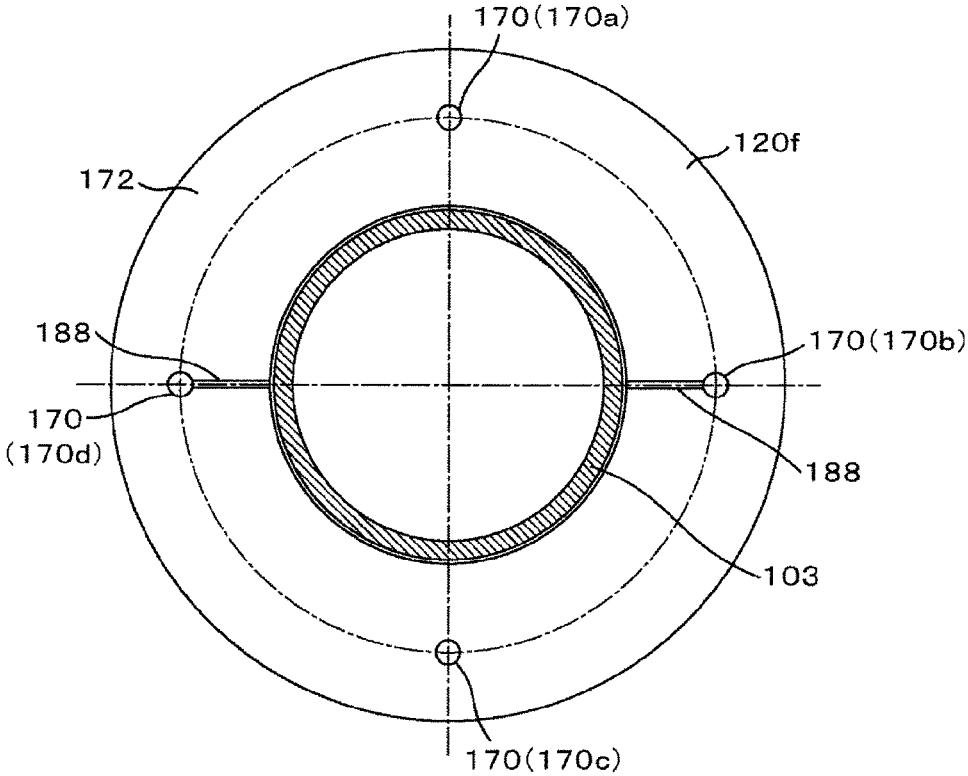
FIG. 6 is a diagram, corresponding to FIG. 3, showing a second embodiment of the present invention.

A second embodiment of the present invention will be described with reference to FIG. 6. FIG. 6, like FIG. 3 for the first embodiment, shows the boss end surface 120*f* on the back side of the orbiting scroll 120. The boss end surface 120*f* of the second embodiment is the same as that of the first embodiment except for the locations where the grooves 188 are located.

As in the first embodiment, four small holes 170 (170*a*, 170*b*, 170*c* and 170*d*) are circularly evenly spaced apart on the boss end surface 120*f*. Of the four small holes, the small holes 170*b* and 170*d* circularly spaced 180 degrees apart are each communicated with one of the grooves 188 that are communicated with the high pressure hydraulic chamber 182 formed in the boss portion. With at least two grooves 188 located symmetrically on the boss end surface of the orbiting scroll 120, the high pressure hydraulic chamber 182 and the back pressure chamber 180 can be kept communicated with each other through at least one of the two symmetrically located grooves. According to the second embodiment, part of the lubricating oil supplied to the high pressure hydraulic chamber can be continuously supplied, by differential pressure lubrication, to the back pressure chamber. According to the second embodiment, too, effects similar to those generated by the first embodiment can be obtained. Namely, when the scroll compressor is operating at a low rotational frequency, the back pressure chamber is lubricated mainly by differential pressure lubrication through the grooves 188, so that lubrication required during operation at a low rotational frequency can be adequately secured. This improves lubrication of sliding parts and sealing of the compression mechanism section 2 to enhance the efficiency of the scroll compressor. When the scroll compressor is operating at a high rotational frequency, adequate lubrication can be secured using both differential pressure lubrication effected through the grooves 188 and pocket oil-supply effected through the small holes 170 to supply more lubricating oil at a higher rotational frequency. Thus, the second embodiment can realize a highly reliable scroll compressor. Note that the amount of lubricating oil supply can be adjusted by appropriately changing the numbers and sizes of the small holes and grooves.

Third Embodiment

Figure 7:
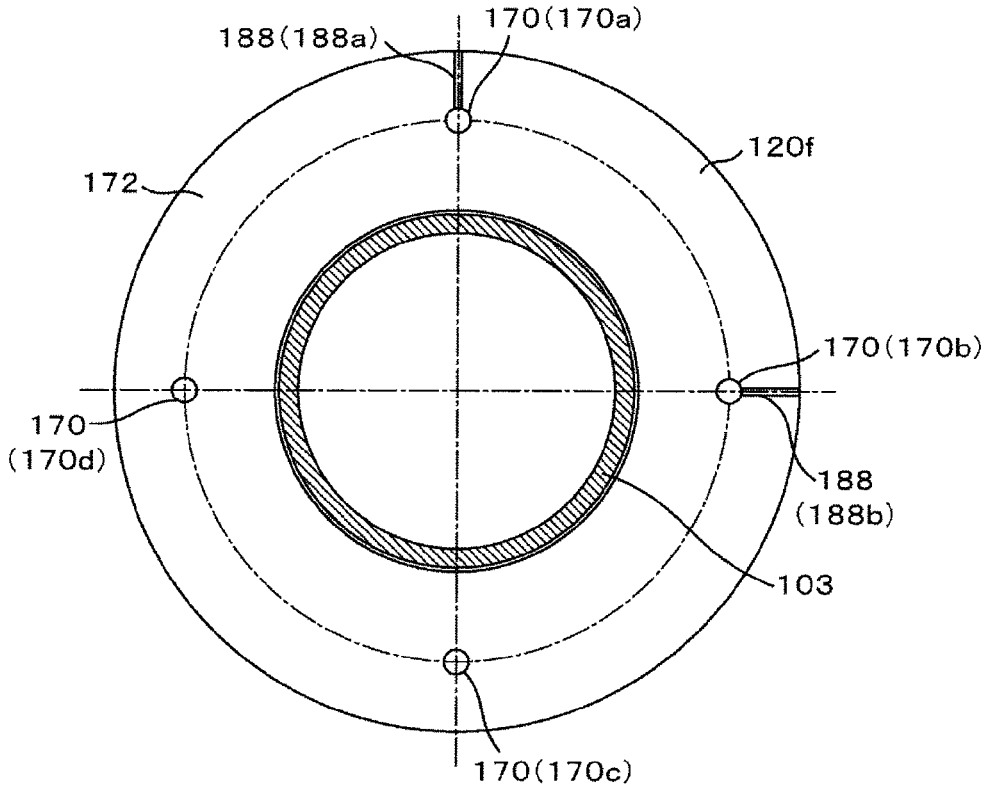
FIG. 7 is a diagram, corresponding to FIG. 3, showing a third embodiment of the present invention.

A third embodiment of the present invention will be described with reference to FIG. 7. FIG. 7, like FIG. 3 for the first embodiment, shows the boss end surface 120*f* on the back side of the orbiting scroll 120. The boss end surface 120*f* of the third embodiment is the same as that of the first embodiment except for the locations where the grooves 188 are located.

As in the first embodiment, four small holes 170 (170*a*, 170*b*, 170*c* and 170*d*) are circularly evenly spaced apart on the boss end surface 120*f*. As shown in FIG. 7, the four small holes 170 are formed on the boss end surface 120*f* to be circularly spaced 90 degrees apart with each positioned approximately at the width center of the boss end surface 120*f*. Of the four small holes, the small holes 170*a* and 170*b* circularly spaced 90 degrees apart are each communicated with one of the two grooves 188 that are communicated with the back pressure chamber 180 formed in an outer peripheral portion of the boss portion. The two grooves 188 are located not symmetrically about the center of the boss end surface 120*f* (to be 180 degrees apart) but 90 degrees apart allowing, when the orbiting scroll orbitally moves, the high pressure hydraulic chamber 182 and the back pressure chamber 180 to be intermittently communicated with each other through the small holes 170*a* and 170*b* and the grooves 188.

Figure 4D:
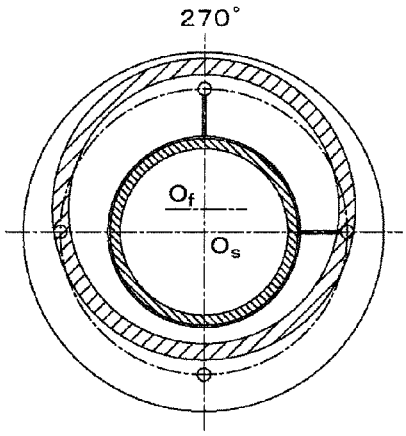
Figure 4C:
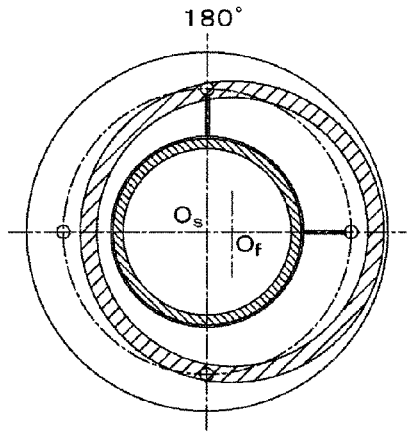

Namely, with the small holes 170*a* and 170*b* moving back and forth across the sealing member 172 partitioning the high pressure hydraulic chamber 182 and the back pressure chamber 180, when at least one of the small holes 170*a* and 170*b* comes to be communicated with the high pressure hydraulic chamber, part of the lubricating oil supplied to the high pressure hydraulic chamber is supplied, by a differential pressure, from the high pressure hydraulic chamber to the back pressure chamber through at least one of the grooves 188. When the small holes 170*a* and 170*b* are communicated with the back pressure chamber, the high pressure hydraulic chamber and the back pressure chamber are not communicated with each other. With the two grooves 188 located not symmetrically about the center of the boss end surface 120*f* but asymmetrically to be spaced 90 degrees apart, when the orbiting scroll orbitally moves, the high pressure hydraulic chamber and the back pressure chamber are intermittently communicated with each other through at least one of the small holes and the groove communicated with the small hole. In the third embodiment, the high pressure hydraulic chamber and the back pressure chamber are communicated with each other when the scroll compressor is in the rotational phase positions as shown in FIGS. 4C and 4D. Thus, differential pressure lubrication is effected over an angle range of about 135 to 315 degrees.

According to the third embodiment, too, operational effects similar to those generated by the first embodiment can be obtained. Namely, when the scroll compressor is operating at a low rotational frequency, the back pressure chamber is lubricated mainly by differential pressure lubrication through the grooves 188, so that lubrication required during operation at a low rotational frequency can be adequately secured. This improves lubrication of sliding parts and sealing of the compression mechanism section 2 to improve the efficiency of the scroll compressor. When the scroll compressor is operating at a high rotational frequency, adequate lubrication can be secured using both differential pressure lubrication effected through the grooves 188 and pocket oil-supply effected through the small holes 170 to supply more lubricating oil at a higher rotational frequency. Thus, the third embodiment can realize a highly reliable scroll compressor.

Fourth Embodiment

Figure 8:
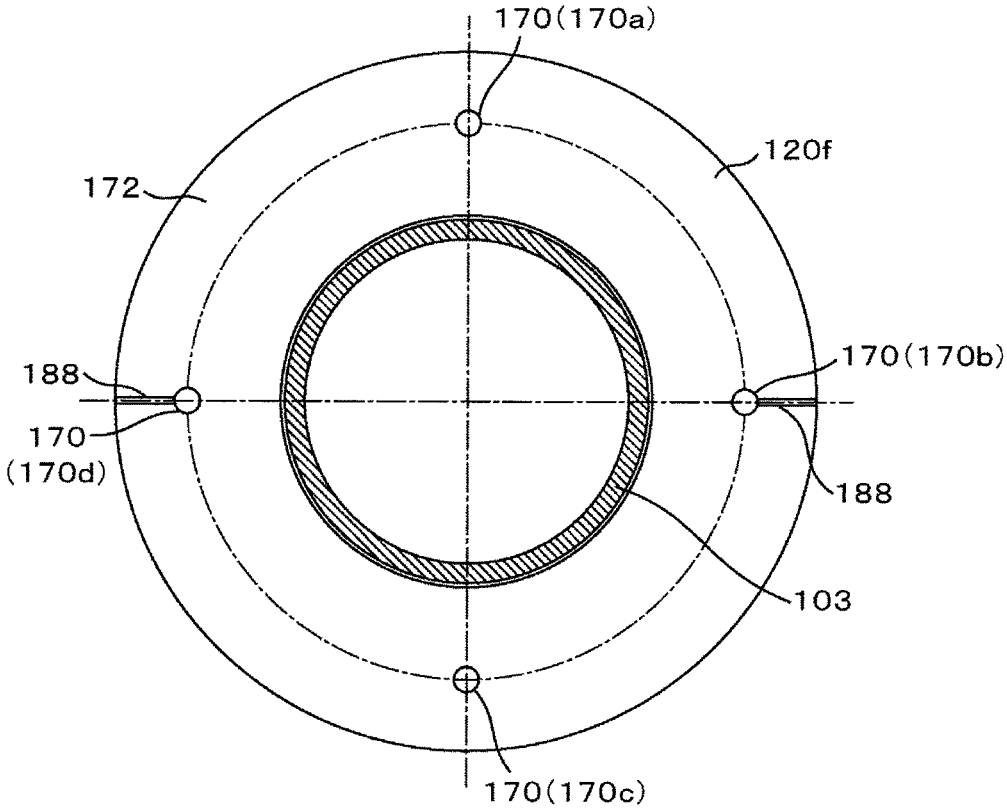
FIG. 8 is a diagram, corresponding to FIG. 3, showing a fourth embodiment of the present invention.

A fourth embodiment of the present invention will be described with reference to FIG. 8. FIG. 8, like FIG. 3 for the first embodiment, shows the boss end surface 120*f* on the back side of the orbiting scroll 120. The boss end surface 120*f* of the fourth embodiment is the same as that of the first embodiment except for the locations where the grooves 188 are located.

As in the first embodiment, four small holes 170 (170*a*, 170*b*, 170*c* and 170*d*) are circularly evenly spaced apart on the boss end surface 120*f*. Of the four small holes, the small holes 170*b* and 170*d* circularly spaced 180 degrees apart are each communicated with one of the grooves 188 that are communicated with the back pressure chamber 180 formed around the outer periphery of the boss portion. With at least two grooves 188 located symmetrically on the boss end surface of the orbiting scroll 120, the high pressure hydraulic chamber 182 and the back pressure chamber 180 can be kept communicated with each other through at least one of the two symmetrically located grooves.

According to the fourth embodiment, part of the lubricating oil supplied to the high pressure hydraulic chamber 182 can be continuously supplied, by differential pressure lubrication, to the back pressure chamber 180. According to the fourth embodiment, too, effects similar to those generated by the first embodiment can be obtained. Namely, when the scroll compressor is operating at a low rotational frequency, the back pressure chamber is lubricated mainly by differential pressure lubrication through the grooves 188, so that lubrication required during operation at a low rotational frequency can be adequately secured. This improves lubrication of sliding parts and sealing of the compression mechanism section 2, so that the efficiency of the scroll compressor is improved. When the scroll compressor is operating at a high rotational frequency, adequate lubrication can be secured using both differential pressure lubrication effected through the grooves 188 and pocket oil-supply effected through the small holes 170 to supply more lubricating oil at a higher rotational frequency. Thus, the fourth embodiment can realize a highly reliable scroll compressor.

Fifth Embodiment

Figure 9:
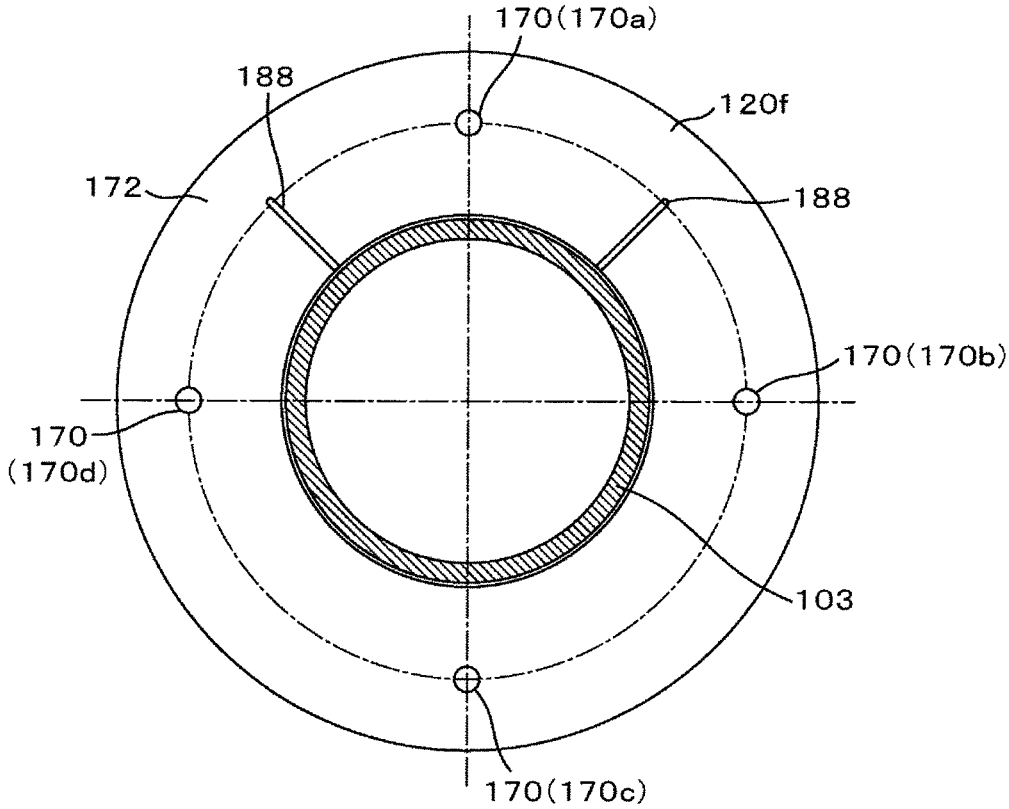
FIG. 9 is a diagram, corresponding to FIG. 3, showing a fifth embodiment of the present invention.

A fifth embodiment of the present invention will be described with reference to FIG. 9. FIG. 9, like FIG. 3 for the first embodiment, shows the boss end surface 120*f* on the back side of the orbiting scroll 120. The boss end surface 120*f* of the fifth embodiment is the same as that of the first embodiment except for the locations where the grooves 188 are located.

As in the first embodiment, four small holes 170 (170*a*, 170*b*, 170*c* and 170*d*) are circularly evenly spaced apart on the boss end surface 120*f*. As shown in FIG. 9, the four small holes 170 are formed on the boss end surface 120*f* to be circularly 90 degrees apart with each positioned approximately at the width center of the boss end surface 120*f*. In the fifth embodiment, the two grooves 188 are spaced 90 degrees apart with one of them located between the small holes 170*a* and 170*d* and the other located between the small holes 170*a* and 170*b*. The two grooves 188 each have a length equal to the distance between a radial position, where one of the small holes is positioned, on the boss-portion end surface and the inner peripheral surface of the boss portion and are always communicated with the high pressure hydraulic chamber 182. In the fifth embodiment, there is no communication between the small holes 170 and the grooves 188. When, while moving back and forth across the sealing member 172, either one of the grooves 188 comes to be communicated with the back pressure chamber outside the sealing member 172, the high pressure hydraulic chamber 182 and the back pressure chamber 180 are communicated through the groove 188 allowing part of the lubricating oil supplied to the high pressure hydraulic chamber to be supplied, by a differential pressure, to the back pressure chamber.

According to the fifth embodiment in which the small holes 170 and the grooves 188 are not communicated, too, effects similar to those generated by the first embodiment can be obtained. Namely, when the scroll compressor is operating at a low rotational frequency, the back pressure chamber is lubricated mainly by differential pressure lubrication through the grooves 188, so that lubrication required during operation at a low rotational frequency can be adequately secured. When the scroll compressor is operating at a high rotational frequency, adequate lubrication can be secured using both differential pressure lubrication effected through the grooves 188 and pocket oil-supply effected through the four small holes 170 to supply more lubricating oil at a higher rotational frequency.

Sixth Embodiment

Figure 10:
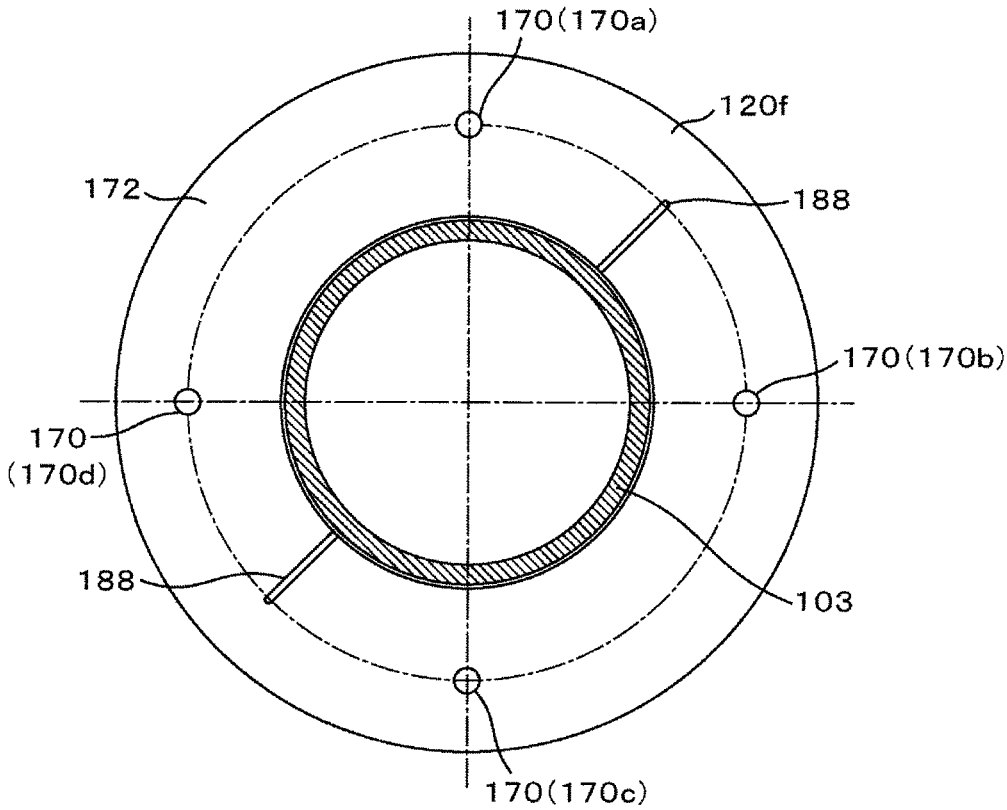
FIG. 10 is a diagram, corresponding to FIG. 3, showing a sixth embodiment of the present invention.

A sixth embodiment of the present invention will be described with reference to FIG. 10. FIG. 10, like FIG. 3 for the first embodiment, shows the boss end surface 120*f* on the back side of the orbiting scroll 120. The boss end surface 120*f* of the sixth embodiment is the same as that of the first embodiment except for the locations where the grooves 188 are located.

As in the first embodiment, four small holes 170 (170*a*, 170*b*, 170*c* and 170*d*) are circularly evenly spaced apart on the boss end surface 120*f*. As shown in FIG. 10, the four small holes 170 are formed on the boss end surface 120*f* to be circularly 90 degrees apart with each positioned approximately at the width center of the boss end surface 120*f*. In the sixth embodiment, the two grooves 188 are spaced 180 degrees apart with one of them located between the small holes 170*a* and 170*b* and the other located between the small holes 170*c* and 170*d*. The two grooves 188 each have a length equal to the distance between a radial position, where one of the small holes is positioned, on the boss-portion end surface and the inner peripheral surface of the boss portion and are always communicated with the high pressure hydraulic chamber 182. In the sixth embodiment, as in the fifth embodiment, there is no communication between the small holes 170 and the grooves 188. When, while moving back and forth across the sealing member 172, either one of the grooves 188 comes to be communicated with the back pressure chamber outside the sealing member 172, the high pressure hydraulic chamber 182 and the back pressure chamber 180 are, as in the fifth embodiment, communicated through the groove 188 allowing part of the lubricating oil supplied to the high pressure hydraulic chamber 182 to be supplied, by a differential pressure, to the back pressure chamber 180. In the sixth embodiment, the two grooves 188 are located symmetrically about the center of the boss end surface 120*f* to be spaced 180 degrees apart, so that, as in the second embodiment, the high pressure hydraulic chamber 182 and the back pressure chamber 180 can be kept communicated with each other through at least one of the grooves 188.

According to the sixth embodiment, also effects substantially similar to those generated by the second and fourth embodiments can be obtained.

Seventh Embodiment

Figure 11:
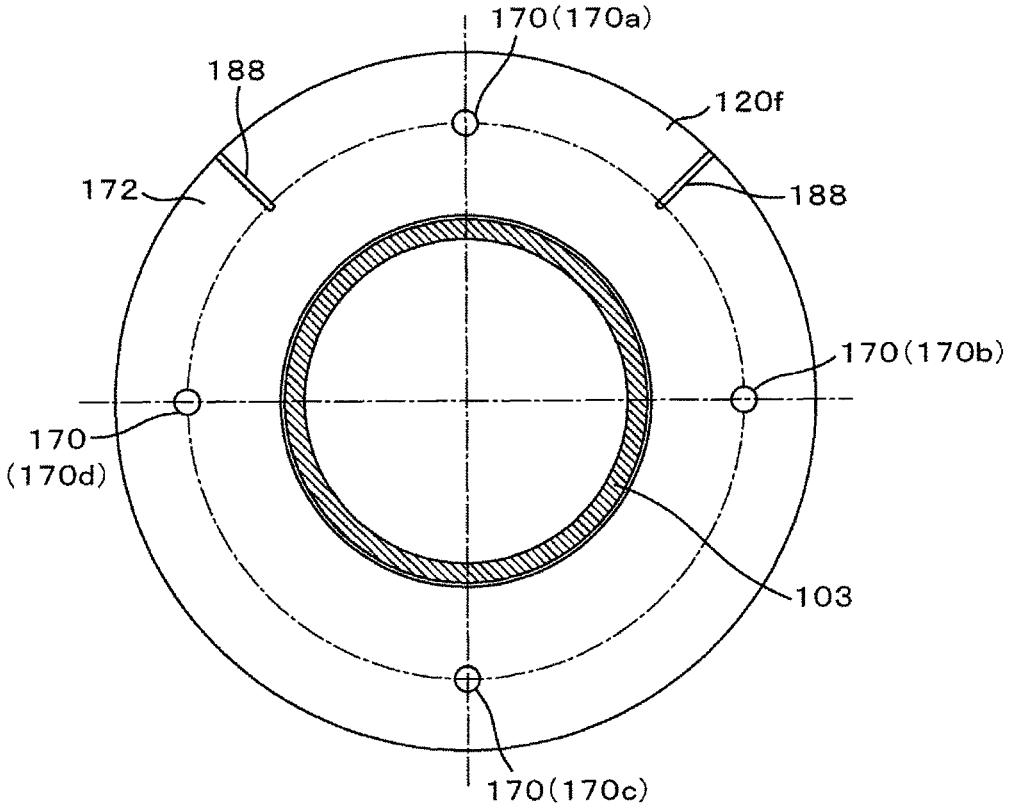
FIG. 11 is a diagram, corresponding to FIG. 3, showing a seventh embodiment of the present invention.

A seventh embodiment of the present invention will be described with reference to FIG. 11. FIG. 11, like FIG. 3 for the first embodiment, shows the boss end surface 120*f* on the back side of the orbiting scroll 120. The boss end surface 120*f* of the seventh embodiment is the same as that of the first embodiment except for the locations where the grooves 188 are located.

As in the first embodiment, four small holes 170 (170*a*, 170*b*, 170*c* and 170*d*) are circularly evenly spaced apart on the boss end surface 120*f*. As shown in FIG. 11, the four small holes 170 are formed on the boss end surface 120*f* to be circularly 90 degrees apart with each positioned approximately at the width center of the boss end surface 120*f*. In the seventh embodiment, as in the fifth embodiment shown in FIG. 9, the two grooves 188 are spaced 90 degrees apart with one of them located between the small holes 170*a* and 170*d* and the other located between the small holes 170*a* and 170*b*. The two grooves 188 each have a length equal to the distance between a radial position, where one of the small holes is positioned, on the boss-portion end surface and the outer peripheral surface of the boss portion and are always communicated with the back pressure chamber 180. In the seventh embodiment, there is no communication between the small holes 170 and the grooves 188. When, while moving back and forth across the sealing member 172, either one of the grooves 188 comes to be communicated with the high pressure hydraulic chamber 182 inside the sealing member 172, the high pressure hydraulic chamber 182 and the back pressure chamber 180 are communicated through the groove 188 allowing part of the lubricating oil supplied to the high pressure hydraulic chamber to be supplied, by a differential pressure, to the back pressure chamber.

According to the seventh embodiment, also effects substantially similar to those generated by the first embodiment shown in FIG. 3 or the fifth embodiment shown in FIG. 9 can be obtained.

Eighth Embodiment

Figure 12:
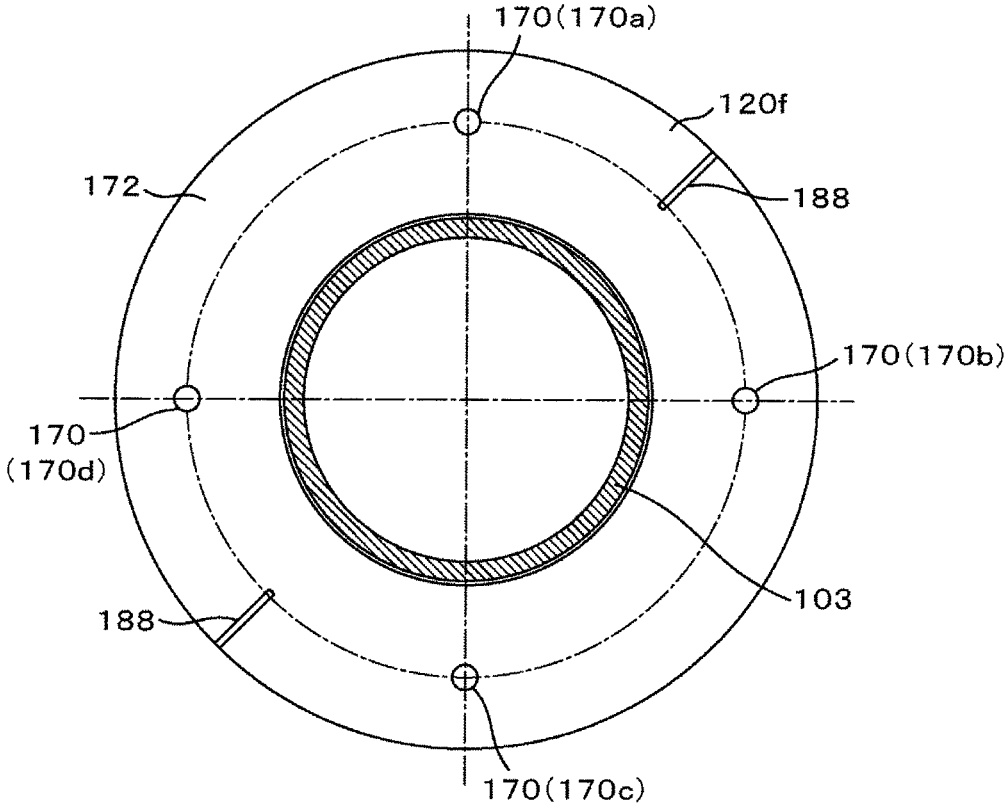
FIG. 12 is a diagram, corresponding to FIG. 3, showing an eighth embodiment of the present invention.

An eighth embodiment of the present invention will be described with reference to FIG. 12. FIG. 12, like FIG. 3 for the first embodiment, shows the boss end surface 120*f* on the back side of the orbiting scroll 120. The boss end surface 120*f* of the eighth embodiment is the same as that of the first embodiment except for the locations where the grooves 188 are located.

As in the first embodiment, four small holes 170 (170*a*, 170*b*, 170*c* and 170*d*) are circularly evenly spaced apart on the boss end surface 120*f*. As shown in FIG. 12, the four small holes 170 are formed on the boss end surface 120*f* to be circularly 90 degrees apart with each positioned approximately at the width center of the boss end surface 120*f*. In the eighth embodiment, as in the sixth embodiment shown in FIG. 10, the two grooves 188 are spaced 180 degrees apart with one of them located between the small holes 170*a* and 170*b* and the other located between the small holes 170*c* and 170*d*. The two grooves 188 each have a length equal to the distance between a radial position, where one of the small holes is positioned, on the boss-portion end surface and the outer peripheral surface of the boss portion and are always communicated with the back pressure chamber 180. In the eighth embodiment there is no communication between the small holes 170 and the grooves 188. When, while moving back and forth across the sealing member 172, either one of the grooves 188 comes to be communicated with the high pressure hydraulic chamber inside the sealing member 172, the high pressure hydraulic chamber 182 and the back pressure chamber 180 are communicated through the groove 188 allowing part of the lubricating oil supplied to the high pressure hydraulic chamber to be supplied, by a differential pressure, to the back pressure chamber. In the eighth embodiment, the two grooves 188 are located symmetrically about the center of the boss end surface 120*f* to be spaced 180 degrees apart, so that, as in the sixth embodiment, the high pressure hydraulic chamber 182 and the back pressure chamber 180 can be kept communicated with each other through at least one of the grooves 188.

According to the eighth embodiment, also effects substantially similar to those generated by the second, fourth, and sixth embodiments can be obtained.

Ninth Embodiment

Figure 13:
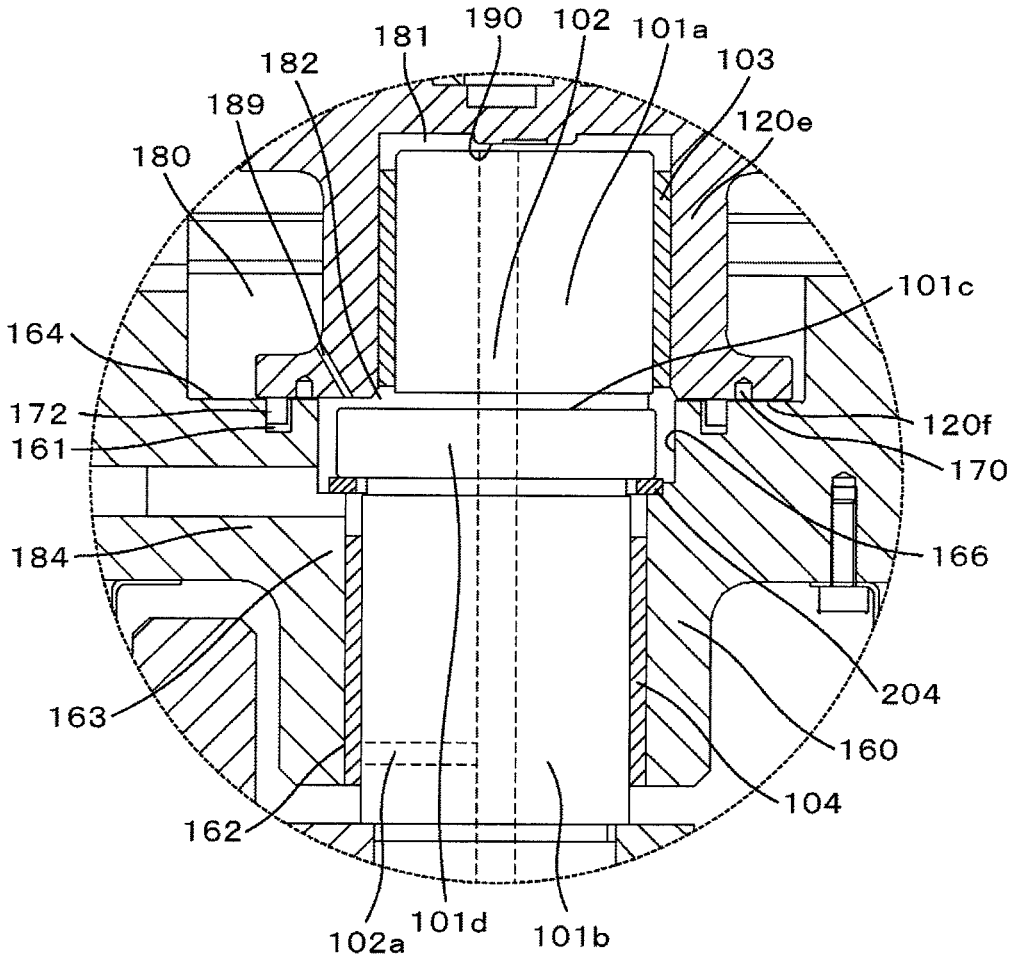
FIG. 13 is a diagram, corresponding to FIG. 2, showing a ninth embodiment of the present invention.

A ninth embodiment of the present invention will be described with reference to FIG. 13. FIG. 13 is equivalent to FIG. 2 showing an enlarged view of a portion around the high pressure hydraulic chamber and the back pressure chamber shown in FIG. 1 (portion A shown in FIG. 1) for the first embodiment. The arrangement of the portion shown in FIG. 13 is the same as that of the portion shown in FIG. 2 except that the grooves 188 shown in FIG. 2 are replaced by a long hole 189 in FIG. 13.

On the back side of the orbiting scroll 120, the high pressure hydraulic chamber 182 formed in a center portion and the back pressure chamber 180 formed in an outer peripheral portion are partitioned by the sealing member 172 fitted in the annular groove 161 formed on the frame 160. The plural small holes 170 formed on the boss end surface of the orbiting scroll 120 allow, by moving back and forth across the sealing member 172 partitioning the high-pressure hydraulic chamber 182 and the back pressure chamber 180, part of the lubricating oil supplied to the high pressure hydraulic chamber to be intermittently supplied, by a pocket oil-supply system, to the back pressure chamber. In the ninth embodiment, the boss portion of the orbiting scroll 120 includes, instead of the grooves 188 shown in FIG. 2, at least one long hole 189 communicating between the high pressure hydraulic chamber 182 and the back pressure chamber 180. With the high pressure hydraulic chamber 182 and the back pressure chamber 180 always communicated through the long hole 189, lubrication is effected by a differential pressure between the two chambers.

According to the ninth embodiment, also effects substantially similar to those generated by the second, fourth, sixth, and eighth embodiments can be obtained. Namely, when the scroll compressor is operating at a low rotational frequency, the back pressure chamber 180 is lubricated mainly by differential pressure lubrication through the long hole 189, so that lubrication required during operation at a low rotational frequency can be adequately secured. This improves lubrication of sliding parts and sealing of the compression mechanism section 2 to improve the efficiency of the scroll compressor. When the scroll compressor is operating at a high rotational frequency, adequate lubrication can be secured using both differential pressure lubrication effected through the long hole 189 and pocket oil-supply effected through the small holes 170 to supply more lubricating oil at a higher rotational frequency. Thus, the ninth embodiment can realize a highly reliable scroll compressor. Note that the amount of lubricating oil supply can be adjusted by appropriately changing the numbers and sizes of the small holes and long holes.

Even though the ninth embodiment has been described based on an example in which only one long hole 189 is provided in a position to keep the high pressure hydraulic chamber 182 and the back pressure chamber 180 communicated with each other, there may be two or more long holes 189 provided. A different arrangement may also be used in which the opening on the boss end surface side of the long hole 189 is opened and closed using a sealing member or in which the long hole 189 is communicated with one of the small holes 170 so as to intermittently open and close the lubricant passage formed by the long hole 189 to allow part of the lubricating oil supplied to the high pressure hydraulic chamber 182 to be intermittently supplied to the back pressure chamber 180.

Furthermore, in the foregoing embodiments, the boss portion of the orbiting scroll includes the small holes and grooves or the long hole. In cases where a sealing part is provided not on the boss end surface of the orbiting scroll but on the back side of an orbiting scroll end plate or on a frame portion facing the back side of the orbiting scroll end plate, operational effects substantially similar to those generated by the foregoing embodiments can be obtained by providing the small holes and grooves or the long hole, for example, on a frame portion where the sealing part is subjected to sliding or on the orbiting scroll end plate.

In the foregoing embodiments, effects of both a differential pressure lubrication system using grooves to secure lubrication without being affected by the rotational frequency of the scroll compressor and a pocket oil-supply system using small holes can be generated. Therefore, when the scroll compressor is operating at a low rotational frequency, adequate lubrication can be secured using differential pressure lubrication effected through the grooves and, when the scroll compressor is operating at a high rotational frequency, lubrication required at a high rotational frequency can be secured by a pocket oil-supply system using small holes to supply more lubricating oil at a higher rotational frequency. Thus, the foregoing embodiments can realize a scroll compressor which can operate highly reliably and efficiently over a low to high range of rotational frequency causing neither inadequate lubrication nor excessive lubrication.

The foregoing embodiments can, therefore, improve the efficiency at a low rotational frequency of a scroll compressor, compared with existing scroll compressors, while avoiding excessive lubrication at a high rotational frequency.

Also, in the foregoing embodiments, adding the grooves where no small hole is provided makes it possible to intermittently or continuously supply lubricating oil to the sealing member even where no small hole is provided, so that oil leakage through the sealing member can be reduced to improve the reliability of the sealing member. This adds to the above described effects of the foregoing embodiments.

In the foregoing embodiments, the small holes and grooves are used to intermittently or continuously supply lubricating oil from the high pressure hydraulic chamber formed around a central portion of the orbiting scroll to the back pressure chamber formed in an outer peripheral portion of the orbiting scroll, allowing the small holes to effect lubrication dependent on the rotational frequency of the scroll compressor and the grooves to effect lubrication dependent on a differential pressure. According to these embodiments in which the small holes and grooves are both made use of, adequate lubrication can be secured even when the scroll compressor is operating at a low rotational frequency, whereas, during operation at a high rotational frequency, lubrication can be increased according to the rotational frequency of the scroll compressor. Thus, it is possible to appropriately control the amount of lubricating oil supply over a low to high range of rotational frequency of the scroll compressor. Moreover, since the small holes and grooves move back and forth across the sealing member, lubrication of the sealing member is also improved to further improve the reliability of the sealing member.

Furthermore, when an arrangement which includes the small holes and, instead of the grooves, at least one long hole formed in the boss portion of the orbiting scroll for constantly communicating between the high pressure hydraulic chamber and the back pressure chamber is used, lubrication dependent on the rotational frequency of the scroll compressor can be effected using the small holes formed on the boss end surface on the back side of the orbiting scroll through which lubricating oil is intermittently supplied from the high pressure hydraulic chamber to the back pressure chamber, whereas lubrication dependent on a differential pressure can be effected using the long hole. Namely, with both the small holes and the long hole made use of, more lubricating oil can be supplied for operation at a low rotational frequency, whereas the supply of lubricating oil can be appropriately controlled for operation at a high rotational frequency. Since, for operation at a low rotational frequency, the supply of lubricating oil can be increased, compression chamber sealing and compression efficiency can be improved. Since, for operation at a high rotational frequency, the supply of lubricating oil can be appropriately controlled, the amount of lubricating oil flowing into the compression chamber can be reduced. This greatly reduces the proportion of lubricating oil mixed in the gas discharged from the compression chamber, so that the amount of lubricating oil led into a refrigeration cycle from the discharge pipe (i.e. the amount of oil discharge) can be reduced. Thus, not only the efficiency of the refrigeration cycle can be improved but also a highly efficient and reliable scroll compressor constantly holding an adequate amount of lubricating oil can be realized.

What is claimed is:

1. A scroll compressor, comprising:

a fixed scroll and an orbiting scroll, each having an end plate and a spiral wrap erected on the end plate;

a compression chamber, formed by the fixed scroll and the orbiting scroll engaged with each other;

a crankshaft, configured to make the orbiting scroll move orbitally;

an orbiting bearing, provided in a boss portion on a back side of the orbiting scroll, and configured to support the orbiting scroll axially movably and rotatably relative to an eccentric pin portion of the crankshaft;

a frame, disposed on a fixed side facing the back side of the orbiting scroll;

a main bearing, attached to the frame, and configured to rotatably support the crankshaft;

a sealing part, configured to seal between the back side of the orbiting scroll and the frame; and a high pressure hydraulic chamber formed in an inner peripheral portion, and a back pressure chamber formed in an outer peripheral portion, which are partitioned by the sealing part, wherein the high pressure hydraulic chamber is kept approximately at a discharge pressure with lubricating oil supplied thereto at approximately the discharge pressure, and wherein the back pressure chamber is kept at a pressure lower than the discharge pressure;

an oil supply unit, including at least one small hole with a diameter not exceeding a seal ring width of the sealing part, wherein the at least one small hole is formed in a portion of the back side of the orbiting scroll or in the frame that faces the sealing part, and wherein the at least one small hole is caused to move, by the orbital motion of the orbiting scroll, across the sealing part such that the at least one small hole is alternately open to the high pressure hydraulic chamber and the back pressure chamber, thereby supplying oil in the high pressure chamber to the back pressure chamber; and at least one groove, formed on a boss end surface of the orbiting scroll opposing the frame, wherein each small hole of the at least one small hole is configured to communicate with the high pressure hydraulic chamber in the boss portion through a respective groove of the at least one groove, and wherein each of the at least one groove is narrower than the at least one small hole;

wherein when a phase angle of the orbital motion of the orbiting scroll is within a predetermined phase angle range, each of the at least one groove is configured to intermittently communicate between the high pressure hydraulic chamber and the back pressure chamber, and configured to supply oil in the high pressure hydraulic chamber to the back pressure chamber, as a result of a differential pressure generated from the communication between the high pressure hydraulic chamber and the back pressure chamber; and wherein when the phase angle of the orbital motion of the orbiting scroll is not within the predetermined phase angle range, the at least one groove is located on the same side of the high pressure hydraulic chamber side partitioned by the sealing part, and configured to not supply oil from the high pressure hydraulic chamber to the back pressure chamber.

2. The scroll compressor according to claim 1, wherein the at least one groove is provided in a portion, facing the sealing part, of the orbiting scroll; and wherein the high pressure hydraulic chamber in the orbiting boss portion and the back pressure chamber are caused, by the orbital motion of the orbiting scroll, to intermittently communicate with each other via the seal ring of the sealing part, so as to intermittently discharge oil in the high pressure hydraulic chamber in the orbiting boss portion to the back pressure chamber.

3. The scroll compressor according to claim 2, wherein the at least one groove includes a groove formed on a back side portion of the orbiting scroll, facing the sealing part.

4. The scroll compressor according to claim 3, further comprising:

a plurality of grooves circularly spaced apart on a boss-portion end surface of the orbiting scroll, the plurality of grooves configured to intermittently communicate the high pressure hydraulic chamber and the back pressure chamber as the orbiting scroll orbitally moves.

5. The scroll compressor according to claim 4, wherein the plurality of the grooves are circularly spaced approximately 90 degrees apart.

6. The scroll compressor according to claim 3, further comprising:

a plurality of grooves circularly spaced apart so as to be positionally approximately symmetric on a boss-portion end surface of the orbiting scroll, thereby causing, even when the orbiting scroll orbitally moves, the high pressure hydraulic chamber and the back pressure chamber to be kept communicated with each other through at least one of the plurality of the grooves.

7. The scroll compressor according to claim 3, wherein the at least one groove has a width smaller than the diameter of the at least one small hole.

8. The scroll compressor according to claim 2, wherein a first end of the at least one groove is configured to communicate with the at least one small hole, and a second end of the at least one groove is kept open to one of the high pressure hydraulic chamber and the back pressure chamber.

9. The scroll compressor according to claim 1, further comprising:

a long hole formed in the boss portion of the orbiting scroll, and configured to keep the high pressure hydraulic chamber and the back pressure chamber in communication with each other.

10. The scroll compressor according to claim 1, wherein when the phase angle of the orbital motion of the orbiting scroll exceeds 180 degrees, and is less than 270 degrees, thereby exceeding the predetermined phase angle range, of 0 degrees to 90 degrees; and wherein none of the at least one groove communicates between the high pressure hydraulic chamber inside the sealing member and the back pressure chamber outside the sealing member.

11. A scroll compressor, comprising:

a fixed scroll and an orbiting scroll, each having an end plate and a spiral wrap erected on the end plate;

a compression chamber, formed by the fixed scroll and the orbiting scroll engaged with each other;

a crankshaft, configured to make the orbiting scroll move orbitally;

an orbiting bearing, provided in a boss portion on a back side of the orbiting scroll, and configured to support the orbiting scroll axially movably and rotatably relative to an eccentric pin portion of the crankshaft;

a frame, disposed on a fixed side facing the back side of the orbiting scroll;

a main bearing, attached to the frame, and configured to rotatably support the crankshaft;

a sealing part, configured to seal between the back side of the orbiting scroll and the frame; and a high pressure hydraulic chamber formed in an inner peripheral portion, and a back pressure chamber formed in an outer peripheral portion, which are partitioned by the sealing part, wherein the high pressure hydraulic chamber is kept approximately at a discharge pressure with lubricating oil supplied thereto at approximately the discharge pressure, and wherein the back pressure chamber is kept at a pressure lower than the discharge pressure;

an oil supply unit, including at least one small hole with a diameter not exceeding a seal ring width of the sealing part, wherein the at least one small hole is formed in a portion of the back side of the orbiting scroll or in the frame that faces the sealing part, and wherein the at least one small hole is caused to move, by the orbital motion of the orbiting scroll, across the sealing part such that the at least one small hole is alternately open to the high pressure hydraulic chamber and the back pressure chamber, thereby supplying oil in the high pressure chamber to the back pressure chamber; and at least one groove, formed on a boss end surface of the orbiting scroll opposing the frame, wherein a first small hole of the at least one small hole is configured to communicate with the high pressure hydraulic chamber in the boss portion through a groove of the at least one groove, and wherein each of the at least one groove is narrower than the at least one small hole;

wherein as the orbiting scroll rotates, the at least one groove intermittently communicates between the high pressure hydraulic chamber and the back pressure chamber, and supplies oil in the high pressure hydraulic chamber to the back pressure chamber, as a result of a differential pressure generated from the communication between the high pressure hydraulic chamber and the back pressure chamber; and wherein the oil is supplied intermittently, by pocket oil-supply, from the high pressure hydraulic chamber to the back pressure chamber, through a second small hole of the at least one small hole which does not communicate with the at least one groove.

12. The scroll compressor according to claim 11, wherein the at least one groove is provided in a portion, facing the sealing part, of the orbiting scroll; and wherein the high pressure hydraulic chamber in the orbiting boss portion and the back pressure chamber are caused, by the orbital motion of the orbiting scroll, to intermittently communicate with each other via the seal ring of the sealing part, so as to intermittently discharge oil in the high pressure hydraulic chamber in the orbiting boss portion to the back pressure chamber.

13. The scroll compressor according to claim 12, wherein the at least one groove includes a groove formed on a back side portion of the orbiting scroll, facing the sealing part.

14. The scroll compressor according to claim 13, further comprising:

a plurality of the grooves circularly spaced apart on a boss-portion end surface of the orbiting scroll, the grooves configured to intermittently communicate the high pressure hydraulic chamber and the back pressure chamber as the orbiting scroll orbitally moves.

15. The scroll compressor according to claim 14, wherein the plurality of the grooves are circularly spaced approximately 90 degrees apart.

16. The scroll compressor according to claim 13, further comprising:

a plurality of the grooves circularly spaced apart so as to be positionally approximately symmetric on a boss-portion end surface of the orbiting scroll, thereby causing, even when the orbiting scroll orbitally moves, the high pressure hydraulic chamber and the back pressure chamber to be kept communicated with each other through at least one of the plurality of the grooves.

17. The scroll compressor according to claim 13, wherein the groove has a width smaller than the diameter of the at least one small hole.

18. The scroll compressor according to claim 12, wherein a first end of the groove is configured to communicate with the first small hole of the at least one small hole, and a second end of the groove is kept open to one of the high pressure hydraulic chamber and the back pressure chamber.

19. The scroll compressor according to claim 11, further comprising:

a long hole formed in the boss portion of the orbiting scroll, and configured to keep the high pressure hydraulic chamber and the back pressure chamber in communication with each other.

20. The scroll compressor according to claim 11, wherein when the phase angle of the orbital motion of the orbiting scroll exceeds 180 degrees, and is less than 270 degrees, thereby exceeding a predetermined phase angle range of 0 degrees to 90 degrees, none of the at least one groove communicates between the high pressure hydraulic chamber inside the sealing member and the back pressure chamber outside the sealing member.

* * * * *